US005497833A

United States Patent [19]

Kaylor

[11] Patent Number: 5,497,833

[45] Date of Patent: Mar. 12, 1996

[54] GAS BOOSTED NOZZLES AND METHODS FOR USE

[75] Inventor: Joseph B. Kaylor, Manassas, Va.

[73] Assignee: Valkyrie Scientific Proprietary, L.C., Reston, Va.

[21] Appl. No.: 224,698

[22] Filed: Apr. 8, 1994

[51] Int. Cl.[6] ..... A62C 3/06

[52] U.S. Cl. ..... 169/15; 169/44; 169/66

[58] Field of Search ..... 169/4, 5, 13, 15, 169/24, 43, 44, 46, 47, 70; 239/2.2, 8, 9, 14.2, 214.11, 214.17, 310, 311

[56] References Cited

U.S. PATENT DOCUMENTS 2,990,885 7/1961 Brazier ..... 169/15

5,377,765 1/1995 Kaylor ..... 169/15

*Primary Examiner*—Jesus D. Sotelo

*Attorney, Agent, or Firm*—Roland H. Shubert

[57] ABSTRACT

The performance and throw distance of a nozzle discharging a water stream is enhanced by injecting a liquified gas, suitably liquid nitrogen or liquid carbon dioxide, into the water entering the nozzle at a point sufficently upstream from the nozzle to allow complete vaporization or solidification of the liquified gas before it leaves the nozzle. A second material, that may be a foam producing composition or a particulate solid, may be introduced into the water entering the nozzle simultaneously with the introduction of the liquified gas.

20 Claims, 2 Drawing Sheets

GAS BOOSTED NOZZLES AND METHODS FOR USE

TECHNICAL FIELD

This invention relates generally to methods and means for enhancing the performance of liquid nozzles by injecting a stream of a liquified gas into the nozzle upstream of the nozzle tip.

Specific embodiments of this invention include the injection of either liquid nitrogen or liquid carbon dioxide into flowing water just upstream of a nozzle from which the water issues to obtain a greater throw distance of the water stream and to enhance its fire extinguishing properties.

BACKGROUND ART

It has long been known to use a nozzle to direct a stream of water upon a target for purposes as diverse as hydraulic mining and fire extinguishing. Likewise, it is well known to direct a stream of gas through a nozzle to provide thrust for propulsion, to extinguish fires, and for a host of other applications. It is also known to simultaneously direct two fluids through a single nozzle. Such two-fluid nozzles are typically employed to atomize a liquid using the force of an expanding gas, usually steam or air, to shear the liquid into tiny droplets.

Despite the highly developed state of nozzle technology, the injection of a liquified gas into water issuing from a nozzle has heretofore escaped notice.

DISCLOSURE OF THE INVENTION

This invention provides a method and means for injecting a stream of a liquified gas, particularly a gas that is liquid only under high pressures or at cryogenic temperatures, into flowing water issuing from a nozzle. The liquified gas, suitably nitrogen or carbon dioxide, is injected into the water at a point sufficiently upstream of the nozzle tip so as to allow essentially complete vaporization, or solidification, of the liquified gas to occur prior to its exit from the nozzle. Vaporization of the liquified gas and its expansion as the gas warms to water temperature increases the effective throw distance of the water stream exiting the nozzle. When used for fire fighting purposes, the inert gas dissolved in and carried with the water stream significantly increases the fire extinguishing effectiveness of the water.

Accordingly, it is an object of this invention to enhance nozzle performance.

It is another object of this invention to provide a method and means for increasing the distance that a nozzle can throw a stream of water.

Yet another object of this invention is to provide improved methods and means for fighting fires.

Other objects will become apparent to one skilled in the art from the following description of various modes for carrying out the invention.

MODES FOR CARRYING OUT THE INVENTION

Figure 1:
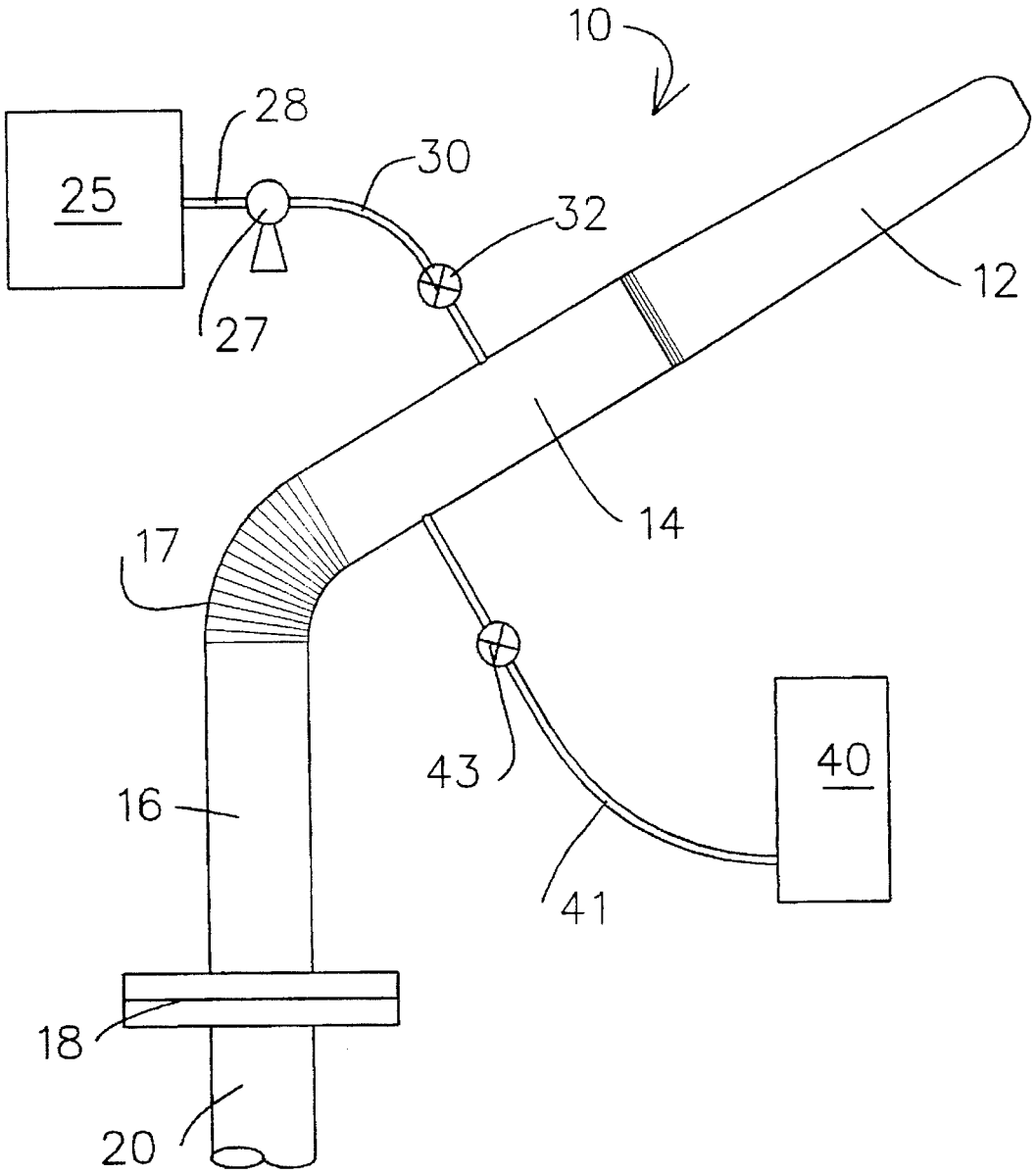
FIG. 1 is a semi-schematic depiction of the system of this invention.

It has been discovered that the injection of a liquified gas into a stream of water discharging from a nozzle at a point just upstream of the nozzle provides a number of significant operating advantages. Among those advantages are an increased throw distance, or range, of the water stream issuing from the nozzle, an enhancement of the fire extinguishing properties of the water stream delivered by the nozzle, and the production of a fire extinguishing foam of superior quality by the addition of a foam concentrate (together with the liquified gas) to the water supplied to the nozzle.

Liquified gases that are appropriate for use in this process are those which are non-flammable and become liquid only under high pressure or at very low temperatures. Particularly preferred among such liquified gases are liquid nitrogen, liquid carbon dioxide, and mixtures of the two. When such liquified gases are injected into a stream of water flowing through a nozzle, the liquid flashes to gas because of the high temperature of the water relative to that of the vaporizing gas. A part of the gas dissolves in the water, and the expansion force of the remaining vaporized gas is exerted upon the flowing water stream, serving to increase the velocity of the water moving through the nozzle. As the water traverses the nozzle, its pressure decreases and approaches atmospheric at the nozzle exit. That pressure decrease causes a further expansion of the gas carried in the water stream with additional force imparted to the flowing water, thus serving to further accelerate the water.

In order to carry out the process of this invention, it is necessary to inject an effective amount of liquified gas into the water but not so much as to allow unvaporized liquified gas to remain in the water exiting the nozzle. Nozzle performance improves as the rate of liquified gas injection relative to the water flow through the nozzle is increased up to that point at which unvaporized liquified gas remains in the water stream leaving the nozzle tip. Vaporization (or solidification) of the liquified gas must be essentially complete prior to its exit from the nozzle tip else the continuing expansion of the vaporizing gas disrupts the unconfined water stream and shortens its throw.

The addition of liquified gas to the water stream at even very low ratios of gas to water produces a discernable improvement in the nozzle performance. Ordinarily, a significant degree of nozzle performance improvement is noted with the injection of as little as 1 volume, or even less, of liquified gas per 1,000 volumes of water. In most cases, however, it is preferred that sufficient liquified gas be injected upstream of the nozzle to provide at least about an equal volume of gas to that of water at the nozzle exit, the gas volume being measured at standard conditions (0° C., 1 atm), while neglecting the solubility of the gas in water. In the circumstance wherein liquid nitrogen is injected into the water stream, that preferred minimum volume ratio is met by an injection rate of about 1.5 volumes of liquid nitrogen per 1,000 volumes of water, or about 6 ml of liquid nitrogen per gallon of water. In the case of liquid carbon dioxide, the preferred minimum volume ratio requires an injection rate of about 2.7 volumes of liquid carbon dioxide per 1,000 volumes of water. That corresponds to about 10 ml of liquid carbon dioxide per gallon of water.

Nitrogen is not very soluble in water so the actual volume of nitrogen gas exiting the nozzle with the water stream will correspond closely to the calculated amount. In contrast, carbon dioxide displays a significant level of solubility in water. At 15° C. and 1 atmosphere pressure, about 1 volume of carbon dioxide gas will dissolve in 1 volume of water. At the same temperature but at a pressure of 4 atmospheres, about 4 volumes of carbon dioxide will dissolve in 1 volume of water.

The differences in solubility between nitrogen and carbon dioxide can be used to provide special advantages in certain specific applications of the process. The use of liquid nitrogen rather than liquid carbon dioxide is of distinct benefit in those circumstances wherein the primary effect desired is an increase in the velocity, and hence the range or throw distance, of a water stream. For example, an increase in the velocity or range of a water stream is of value in water jet cleaning and hydraulic mining applications and in certain fire fighting situations as well. Much of the vaporizing liquid nitrogen remains as an undissolved free gas and the force of its expansion serves to accelerate the movement of water through the nozzle. The water stream leaving the nozzle is, of course, essentially saturated in nitrogen and additional nitrogen gas is entrained in the water and is carried with the water to a target. At the same time, the vaporizing and expanding nitrogen exerts a significant cooling effect upon the water. All of those effects serve to enhance the fire extinguishing capabilities of the water stream.

Injection of liquid carbon dioxide into a water stream has effects similar to those observed with liquid nitrogen except that much more of the carbon dioxide dissolves in the water. At high rates of liquid carbon dioxide addition, a portion of the liquid can go to a solid snow that is carried with the water stream. As compared to liquid nitrogen, the higher solubility of carbon dioxide tends to lessen the propulsive force exerted on the water stream but to enhance the fire extinguishing properties of the water. Also, carbon dioxide injection tends to produce a foam of better quality than does nitrogen in those applications wherein a foam concentrate, as well as a liquified gas, is added to the water stream. Carbon dioxide will continue to come out of solution in the water after the water steam reaches its target. That effect is most pronounced when the water stream is directed at a burning target. Heat from the combustion causes an almost explosive release of expanding gas, mostly carbon dioxide, from the water and from the solid carbon dioxide snow carried in the water. That gas release serves to quench the flame as well as to produce a foam blanket having a small bubble structure. The use of a mixture of liquid carbon dioxide and liquid nitrogen in varying ratios of one to the other allows any desired combination of these effects to be obtained.

Turning now to FIG. 1, there is a schematic depiction of the nozzle system of this invention. The system includes a nozzle assembly depicted generally at 10. Assembly 10 comprises a nozzle member 12, a tail piece assembly 14, and a mount 16. The nozzle member 12 may be of any conventional type including straight stream, air aspirating, and fog nozzles. Tail piece assembly 14 is shown in more detail in FIG. 2. It functions to quiet the flow of water before it enters the nozzle and to provide injection means for the liquified gas and (optionally) a foam producing agent. Mount 16 may comprise a conventional monitor or turret installed on swivel joints 17 and 18 to permit control of the elevation and direction of the nozzle stream. A hose or other conduit 20 is connected to the horizontal swivel joint 18 and communicates between the nozzle assembly and a source of water at an elevated pressure. Conduit 20 may be connected directly to a hydrant or to the output of a pump from a fire boat or engine pumper. Nozzle member 12 and tail piece assembly 14 may also be used with a hand-held nozzle and line, rather than with a mount, but that mode of operation is more difficult to control and generally less effective.

Operation of the system requires a source of liquified gas that conveniently may comprise container 25. When liquid nitrogen is selected as the liquified gas, container 25 comprises an insulated vessel adapted to store liquid nitrogen at moderate pressures, typically in the range of 10 to 100 psig. Liquid nitrogen is transferred into and out of the container vessel by means of transfer pump 27 that communicates with container 25 by way of line 28. Liquid nitrogen from pump 27 is supplied to the system by way of line 30 and is injected into the flowing water stream through a port in tail piece 14 as is shown in greater detail in FIG. 2.

Figure 2:
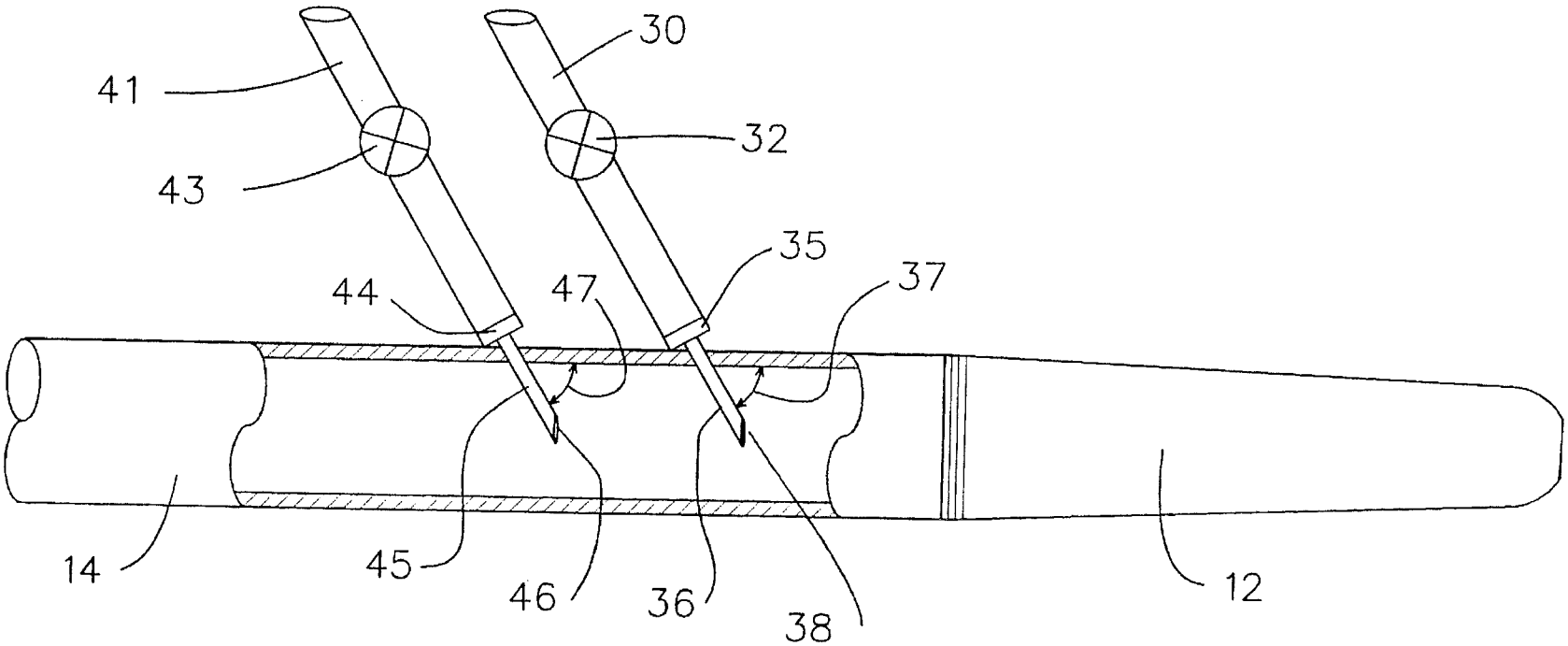
FIG. 2 is a detailed view of a liquified gas and foam concentrate injection member.

Referring now to FIG. 2, as well as to FIG. 1, tail piece 14 comprises a tubular conduit, having a length substantially greater than its diameter, connected at one end to a water supplying member, and connected at the other end to a nozzle. A metering valve or other flow controlling device 32, such as an orifice, is provided in line 30 to regulate or set the flow rate of liquid nitrogen to the tail piece 14. The downstream end of line 30 is connected through flange 35 to an injector tube 36 that is of much smaller diameter than is tail piece member 14, and passes through the wall of that member at an oblique angle 37 to the tail piece axis. Discharge end 38 of tube 36 opens in a downstream direction and is preferably configured as a plane perpendicular to the axis of the tail piece member, and terminating generally near the center of that member. Line 30 must be sufficiently flexible to allow nozzle movement and should be well insulated in order to minimize vaporization of the liquid nitrogen as it travels through the line.

When liquid carbon dioxide is selected as the liquified gas, then container 25 may be either an insulated vessel as was described above, or it may be a pressure vessel capable of withstanding the pressure exerted by liquified carbon dioxide at ambient temperature conditions. Transfer pump 27 is ordinarily not needed when a pressure vessel is used for liquid carbon dioxide storage. Other than that, operation of the system is basically the same whether liquid nitrogen or liquid carbon dioxide is employed. Further, mixtures of the two liquified gases in any proportion may be used if desired.

In many fire fighting applications, it is desirable to include a foam producing composition with the water stream. As is best shown in FIG. 2, there is illustrated an embodiment of this invention that allows the simultaneous injection of a liquified gas and a foam producing composition into the water stream. The foam producing composition may be either a liquid foam concentrate or a mixture of particulate solids that dissolve in the water to produce a fire extinguishing foam.

Introduction of the foam producing composition into the water stream may be accomplished in similar fashion to that employed in the injection of the liquified gas. A foam producing composition from source 40, comprising a stream of either a liquid or of particulate solids, is conveyed through conduit means 41 to deliver a metered stream of a foam producing composition from the supply 40 to tail piece 14 of the nozzle assembly.

A metering valve or other flow controlling device 43 is provided in conduit 41 to start, stop, and regulate the flow of foam producing composition to the tail piece 14. The downstream end of conduit 41 is connected through flange 44 to an injector tube 45 of similar construction to that of injector tube 36. Injector tube 45 is of much smaller diameter than is tail piece member 14, and passes through the wall of that member at an oblique angle 47 to the tail piece axis. As with injector tube 36, the discharge end 46 of tube 45 opens in a downstream direction. End 46 is preferably configured as a plane perpendicular to the axis of the tail piece member, terminating generally near the center of that member. It is not necessary, but is preferred, that the oblique angle 37 that injector tube 36 forms with the wall of tail piece member 14 be the same as that angle 47 formed by injector tube 45 and the tail piece wall. Angles 37 and 47 should fall within the general range of 20° to 60° while the best performance has been obtained when the angle is set between 30° and 45° . It is ordinarily of advantage to introduce the foam producing composition upstream of the liquified gas.

In a test of a full scale operating system, a trailer mounted monitor was equipped with a straight stream nozzle that was 4 inches in diameter at the base, tapering to 3 inches at the tip. A tail piece assembly, similar to that illustrated in FIG. 2, was installed upstream of the nozzle. The tail piece body was about 18 inches long, had an internal diameter of 4 inches, and was equipped with two injection tubes; one for liquified gas, and the other for a foam producing composition. Water was supplied to the monitor from a fire boat pumping to the monitor through two 5-inch hoses at about 180 psig. Liquid nitrogen was supplied to the monitor from a truck-mounted tank equipped with a transfer pump.

The monitor was operated in three different modes; water only, water with liquid nitrogen injection, and water with both liquid nitrogen and foaming agent injection. A considerable increase in nozzle range or throw, on the order of 25% or more, was observed with liquid nitrogen injection as compared to water alone. It was determined from the measured and calculated flow rates of the liquid nitrogen and water that about 3.3 volumes of liquid nitrogen per 1,000 volumes of water were used to produce that result. The nozzle range in the third mode, with foaming agent injection as well as with water, was essentially the same as that observed with liquid nitrogen injection alone. In both modes, the liquid nitrogen-boosted water or water-foam stream was thrown for a distance of approximately 500 feet. In the foam test, a proprietary, particulate solid, foam producing agent was injected just upstream of the liquid nitrogen injection port.

It may be appreciated that the means and methods of this invention, as described in the foregoing disclosure, provide advancements and advantages not previously available to the art. It will also be recognized by those skilled in the art that numerous modifications of the methods and means which have been described can be made without departing from the spirit and scope of the invention.

I claim:

1. A method for enhancing the performance of a nozzle employed in directing a stream of water upon a target comprising: injecting an effective amount of liquified gas into water flowing through said nozzle at a point sufficiently upstream from the outlet of said nozzle to allow essentially complete vaporization and solidification of said liquified gas prior to its exit from the nozzle.

2. The method of claim I wherein said liquified gas is selected from the group consisting of nitrogen, carbon dioxide, and mixtures thereof, and wherein said effective amount is more than that required to obtain saturation of the water with said gas.

3. The method of claim 2 wherein said liquified gas is carbon dioxide.

4. The method of claim 2 wherein said water is employed in fighting a fire and wherein a foam-forming material is mixed with the water flowing through said nozzle at a point upstream of said liquified gas injection.

5. The method of claim 1 wherein a second composition is injected into the water flowing through said nozzle simultaneously with the injection of said liquified gas.

6. The method of claim 5 wherein said composition is a particulate solid and is injected into said water stream upstream of said liquified gas.

7. The method of claim 5 wherein said composition is a liquid foam producing agent and is injected into said water stream upstream of said liquified gas.

8. In a method for fighting a fire in which a stream of water from a nozzle is directed upon a flame, the improvement comprising: introducing an effective amount of a liquified gas selected from the group consisting of liquid nitrogen, liquid carbon dioxide and mixtures thereof into the water upstream of said nozzle and causing said liquified gas to vaporize and to impart an acceleration to said water as it traverses the nozzle.

9. The method of claim 8 wherein said liquified gas is introduced into the water at a rate sufficient to provide a gas volume, measured at standard conditions, at least equal to the volume of water passing through said nozzle.

10. The method of claim 8 wherein vaporization and solidification of said liquified gas is complete prior to its exit from the nozzle.

11. The method of claim 8 wherein a foam producing composition is introduced into said water stream simultaneously with the injection of said liquified gas.

12. The method of claim 11 wherein said liquified gas is carbon dioxide.

13. The method of claim 11 wherein said foam producing composition is a liquid.

14. The method of claim 11 wherein said foam producing composition is a particulate solid.

15. The method of claim 11 wherein said foam producing composition is introduced into said water stream upstream of the place at which said liquified gas is injected.

16. An assembly for projecting a stream of water comprising:

a mount adapted to receive water under pressure;

a tail piece comprising a tubular conduit connected at one end to said mount and arranged to accept a flow of water from said mount, said tubular conduit having means for the introduction of a fluid stream through a wall of said conduit, and into the interior thereof;

a nozzle attached to the other end of said tail piece and adapted to discharge a stream of water;

container means adapted to store a liquified gas; and transfer and control means arranged to deliver a metered amount of liquified gas from said container means into a stream of water flowing through said tail piece.

17. The assembly of claim 16 wherein said tubular conduit includes second means for the introduction of a second fluid stream through a conduit wall and into the interior thereof.

18. The assembly of claim 17 including second container means adapted to store a foam producing composition and metering means arranged to deliver a stream of said composition from said second container means to said second fluid stream introduction means.

19. The assembly of claim 16 wherein said mount comprises a monitor.

20. The assembly of claim 16 wherein each said means for the introduction of a fluid stream through said conduit wall and into the interior thereof comprises an open-ended injection tube passing through said conduit wall at an oblique angle, said tube end configured as a plane generally perpendicular to the axis of said conduit, and said tube end opening pointing in a downstream direction.

* * * * *